US005628400A

United States Patent [19]

Feder

[11] Patent Number: 5,628,400

[45] Date of Patent: May 13, 1997

[54] HOLDING DEVICE FOR RECEIVING TOOLS

[76] Inventor: Emil Feder, Seewjinenstr. 2, CH-3930 Visp, Switzerland

[21] Appl. No.: 360,835

[22] PCT Filed: Apr. 15, 1994

[86] PCT No.: PCT/DE94/00424

§ 371 Date: Dec. 21, 1994

§ 102(e) Date: Dec. 21, 1994

[87] PCT Pub. No.: WO94/23909

PCT Pub. Date: Oct. 27, 1994

[30] Foreign Application Priority Data

Apr. 21, 1993 [DE] Germany ..... 43 13 247.2

[51] Int. Cl.[6] ..... B65D 85/24

[52] U.S. Cl. ..... 206/379; 206/372; 206/443; 206/459.5

[58] Field of Search ..... 206/369, 371, 206/372–379, 443, 459.5

[56] References Cited

U.S. PATENT DOCUMENTS

| | | | |
|---|---|---|---|
| 1,018,729 | 2/1912 | Sine | 206/379 |
| 2,408,227 | 9/1946 | Ramsey | 206/379 |
| 2,564,601 | 8/1951 | Huot | 206/379 |
| 3,074,539 | 1/1963 | Rogovin | 206/379 |
| 3,583,556 | 6/1971 | Wagner | 206/373 |
| 3,870,149 | 3/1975 | Huot | 206/379 |
| 4,006,821 | 2/1977 | Sautter | 206/379 |
| 5,048,700 | 9/1991 | Feder | 211/70.6 |
| 5,071,005 | 12/1991 | Hemmings et al. | 206/443 |
| 5,163,549 | 11/1992 | Hayduchok | 206/371 |
| 5,172,810 | 12/1992 | Brewer | 206/369 |

FOREIGN PATENT DOCUMENTS

| | | |
|---|---|---|
| 2359044 | 2/1978 | France . |
| 7504525 | 6/1975 | Germany . |

*Primary Examiner*—Jimmy G. Foster
*Attorney, Agent, or Firm*—Darby & Darby

[57] ABSTRACT

The invention relates to a holding device for tools, especially drills, such that this holding device is formed by a shell-shaped upper section of the housing and by a base plate which covers the upper section of the housing and which can be fixed thereon, tubular receiving holes, fine measurement channels, and the coarse measurement channel, as well as recesses for the contact bodies of the gauge being integrally formed on the upper section of the housing.

20 Claims, 3 Drawing Sheets

1
3
4
5
6
9
20
21
22
23
24
25
26
27
28
29
30
31
32
33
36
37

HOLDING DEVICE FOR RECEIVING TOOLS

The invention relates to a device for receiving tools.

A device of this type is described in the EP-311 789 B1 or in the U.S. Pat. No. 5,048,700.

The present invention is concerned with the method for manufacturing the receiving device in such a way that, on the one hand, a precise gauge is created for the tools inserted therein and, on the other hand, the expense of manufacturing it is kept as low as possible, so that the overall device can be manufactured economically.

To accomplish this task, on which the invention is based, it is proposed that the housing be manufactured in a suitable way in the shape of a shell with a wall of uniform or variable thickness, e.g. by injection molding a plastic, in such a way that this upper section of the housing is closed by a base. The housing has receiving holes for receiving the tools, e.g. a drill. Several receiving holes per measurement size can also be arranged here arbitrarily above one another and/or next to one another. The upper section of the housing and its base have outer dimensions which correspond to those of the finished receiving device.

The receiving holes preferably are extended by threaded bushes, which can be designed as an independent component. Steadying brackets for receiving and centering the threaded bushes can here be provided on the base plate, so that the individual components are automatically centered when they are inserted into one another. Inside the threaded bushes, adjustment screws can be provided, which form the base of the particular receiving hole and which can be screwed up or down as needed, depending on the length of the tool being received, e.g. a drill, a plug gauge, or the like. These adjustment screws can be operated either by a hex wrench or by a standard screwdriver or also by the drill itself.

The actual gauges can be foraged by pins which can be inserted into the recess. However, round contact bodies have the disadvantage of offering only a relatively small measurement surface since the curvature of the pin really makes available only the very small tangent surface as the actual measurement surface.

The invention furthermore proposes that the actual gauges be formed by plates which can be inserted into the recess. In this case, recesses are provided in these plates so as to form the two mutually opposite measurement surfaces. Here it is possible to design each of these gauges as a plate with a U-shaped recess, or to design the gauges as plates which are cut out U-shaped at the positions that coincide with the fine measurement channels, so that the gauges are connected together, and it is only necessary to insert a plate for each measurement size of several channels. In this case, the gauges suitably are manufactured of flat stock, preferably of metal. Furthermore, the plates or only the edges of the U-shaped cut-outs, which form the actual gauges, can also be hardened.

Another advantage of designing the gauges as plates is that the gauges can be clamped into packages, so that several of these plates can be finish-processed at the same time to the particular dimensions that are intended. At the same time, a coding to classify the plate can be provided on it, a reciprocal coding being provided on the base plate, on the housing, or on another structural part. The edges of the actual gauges are then inserted into the recesses situated in the upper section of the housing.

The individual threaded bushes preferably consist of hemi-shells, which are then joined for actual use. In this connection, it is therefore proposed that each hemi-shell have half of the thread on its inside, the two hemi-shells then being joined by suitable means. The hemi-shells are securely held together by appropriate means, such as clips, glue, rivets, etc. At the same time, their upper and/or lower ends are fastened on the base and/or in the upper section of the housing.

The invention also provides that, after all the structural parts have been. inserted, the upper section of the housing be wholly or partly filled with suitable materials, so that the important gauges will be fixed immovably. It is also possible for only the gauges themselves to be wholly or partly fixed on a structural part.

Embodiments of the invention will be explained below in terms of the drawings. The drawings show the following:

Figure 1:
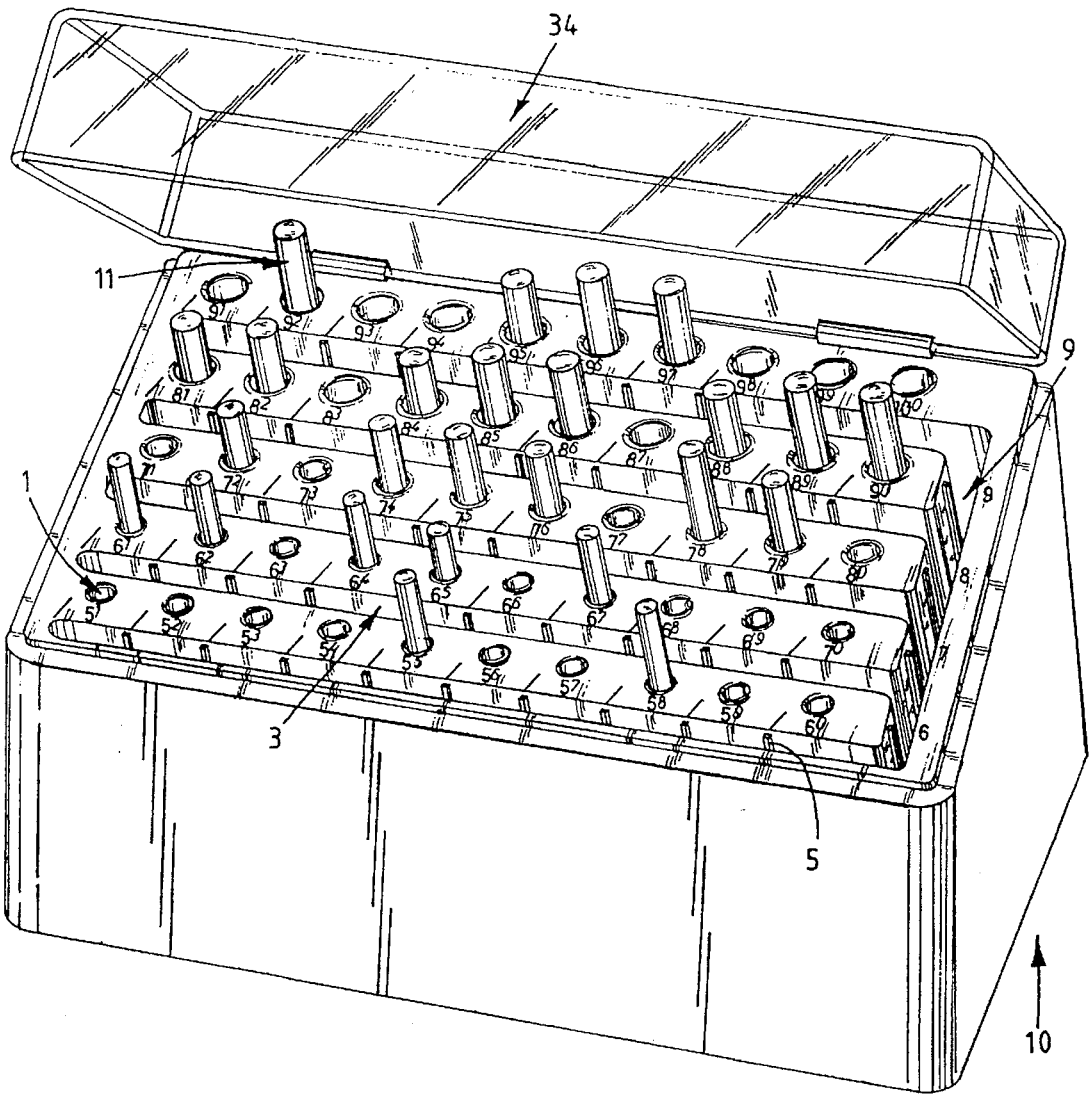
FIG. 1 shows a pictorial view of an inventive receiving device.

FIG. 1 shows a holding device 10, which receives the tools 11, e.g. drills or work pieces, and which is equipped with receiving holes 1 for this purpose. Fine measurement channels 3 are associated with the receiving holes 1. A gauge, possibly also profried, is formed in each of these fine measurement channels 3 through the contact bodies 5 and 6. The gauge essentially extends over the entire height or over part of the height of the fine measurement channel 3.

A coarse measurement channel is designated by 9. Here, too, are situated the measurement gauges 2, possibly profried, and consisting of interacting contact bodies 5 and 6. The drill which is introduced into the coarse measurement channel 9 thus can be conducted through the coarse measurement channel 9 only if it has a nominal diameter which is smaller than the particular gauges 2 which it has reached, these gauges consisting of the contact bodies 5 and 6. The holding device 10 is equipped with a cover 34, so that the working tools can be stored free of contamination.

The structure of the holding device 10 appears more clearly in the following FIGS. 2 through 5. These figures show an upper section 20 of the housing, said upper section 20 being formed, for example, by injection molding or the like. The spaces for the coarse measurement channel 9, the fine measurement channels 3, and the receiving holes 1 are provided during the manufacturing process, as are the recesses 22, into which the gauges 2, which bound the five measurement channels and which are formed of the contact bodies 5 and 6, can be inserted.

The contact bodies 5 and 6 here can be formed of individual pins. The openings for these contact bodies are formed as socket-like receptacles, the pins here being dimensioned so that the contact bodies are indeed held but still have a certain play room in the opening. In this way, on the one hand, form shrinkages during manufacture of the upper section 20 of the housing can be compensated, and, on the other hand, the contact bodies can be fixed by appropriate auxiliary means with the help of a spacer.

In the embodiment shown in FIGS. 2 through 5, however, the contact bodies 5 and 6 are formed by a plate-shaped, U-shaped piece 28, whose upper end has a recess 27, and which, with this embodiment, —as a comparison with FIG.

Figure 5:
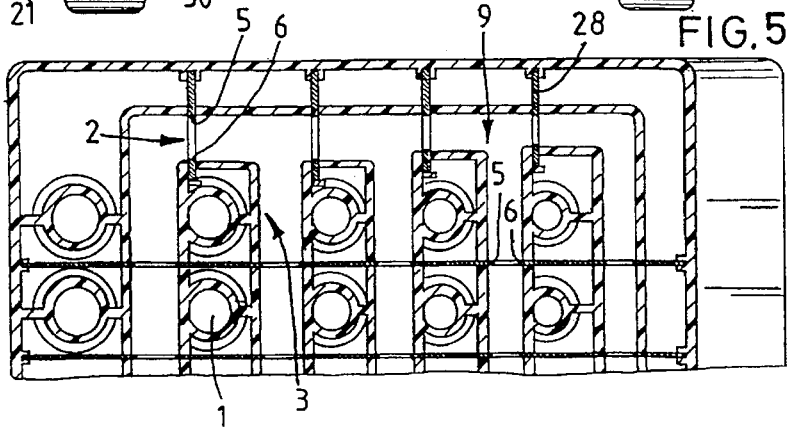
FIG. 5 shows a section according to the Line 5—5 in FIG. 3.

5 shows especially clearly—now creates the gauge 2 for the coarse measurement channel 9. FIG. 5 shows the contact bodies 5 and 6, which have been formed, and which are fixed precisely in place. The U-shaped piece 28 can likewise be seen.

Figure 4:
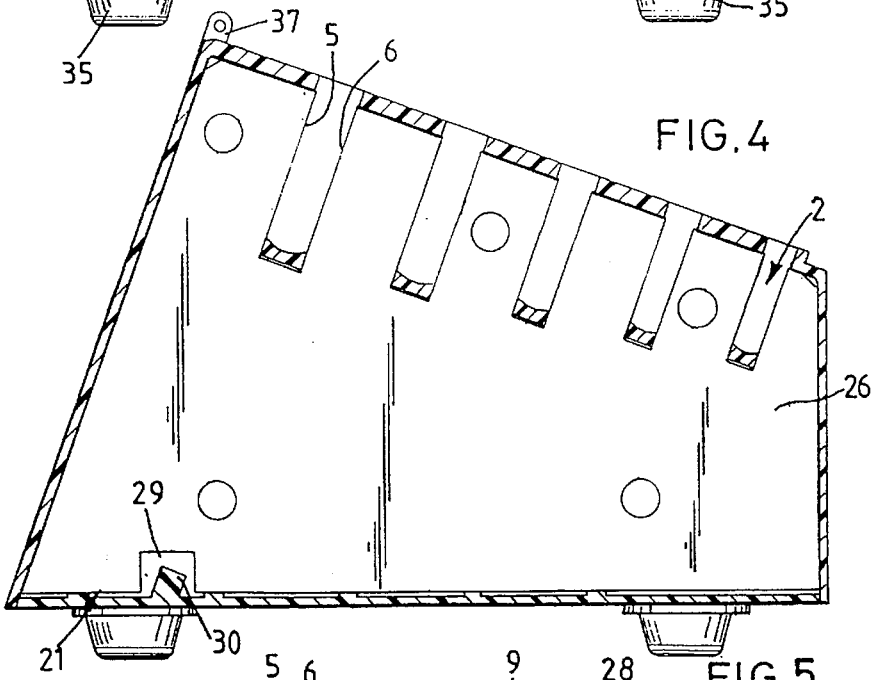
FIG. 4 shows a section according to the Line 4—4 in FIG. 2.

The gauges 2 for the individual fine measurement channels 3 each can be formed by a plate 26 (FIG. 2), which has recesses 27 corresponding to the individual fine measurement channels 3. In this way, the gauges 2 are formed after this plate 26 has been inserted into the corresponding recesses 22 and after it has been fixed in the upper section 20 of the housing and/or at the base plate 21. The plates 26 need not have a complete surface—as shown—but can be limited to the important regions in order to save material. In this embodiment, the plate 26 furthermore has a code 29 on its under side. As FIG. 4 shows, each code situated on each plate 26 corresponds to a reciprocal code 30 situated on a base plate 21.

The receiving holes 2 are also formed in the upper section 20 of the housing. They have a tubular part 23 and also threaded bushes 24, which lead as far as the base plate 21. The threaded bushes 24 are formed of hemi-shells 30 and 32. Each of these hemi-shells contains haft of the thread integrally formed therein. They can be joined to one another by clips, glue, or the like. An adjustment screw 33 can be adjusted inside the threaded bushes 24. This adjustment screw 33 forms the base of each receiving hole 1. Its height adjustment now makes possible adaptation to tools 11 of different length, a feature which is especially important for drills, because the length of the drill is shortened by the constant repointing, without the tool 11 thereby becoming unusable.

Steadying brackets 25 can be integrally formed on the base plate 21. These are used to receive the lower ends of the threaded bushes 24. In this way—as can be seen from FIG. 2—the upper socket-shaped part of the threaded bushes is connected to the lower end of the tubular part 23 of the receiving holes 1. The individual threaded bushes 24 are then securely fixed by the steadying brackets 25. It can also be seen here that the threaded bushes 24 are integrally adapted to several receiving holes 1, so that the device 10 is formed when the set of threaded bushes and the associated plate 26 are successively inserted.

Figure 2:
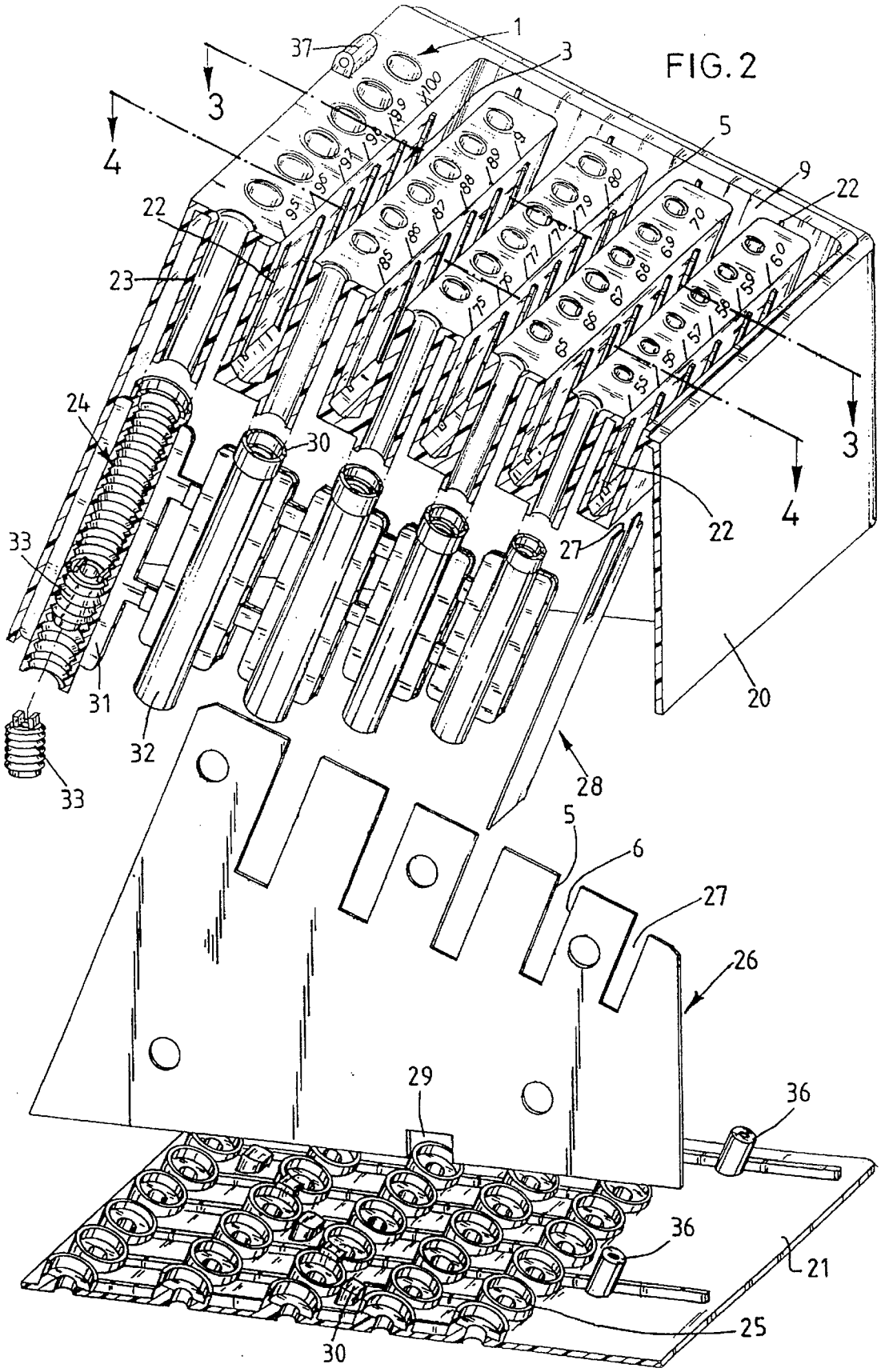
FIG. 2 is an exploded representation of the individual structural parts, some of them shown individually, to form the inventive receiving device.
Figure 3:
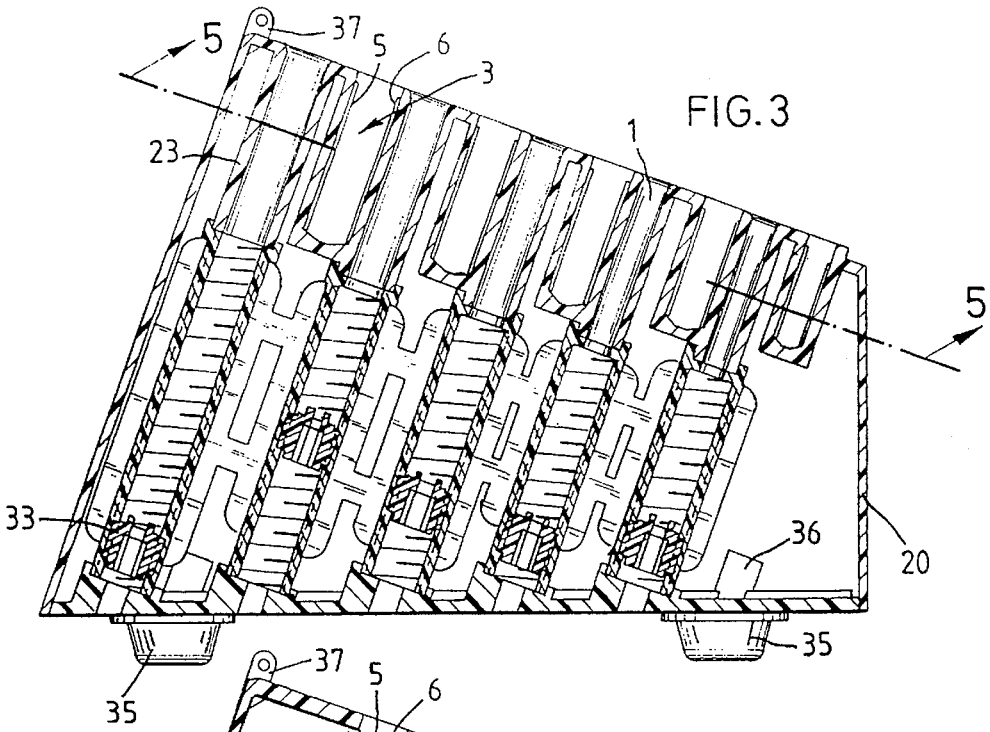
FIG. 3 shows a section according to the Line 3—3 in FIG. 2.

FIG. 3 shows that the base plate is equipped with support feet 35 and that collets 36 are provided to fix them securely on the top side of the base plate 21. FIGS. 2 through 4 also show the swivel eyes 37 for the cover 34.

The actual base plate 21 preferably is screwed together with the upper section 20 of the housing, so that it can be fixed easily but permanently.

The threaded bushes 24, i.e. essentially the hemi-shells 30 and 32, can be equipped with lateral supports, which are oriented to or contact the plates 26, which in mm can be inserted relatively easily so as to be fixed in place. Thus, by means of these lateral supports, a pre-adjustment is achieved, which greatly facilitates mounting the individual parts. In this way, it is possible to align the individual rows of threaded bushes quite precisely in stand-alone fashion, so that, after the plates 26 and the threaded bushes 24 have been inserted, the base plate 21 can easily be placed in position, which then securely arrests the totality of all the parts.

I claim:

1. An article holder, for tools which have cylindrical or polygonal shafts of different dimensions, said article holder comprising:

a housing having an upper section and a base member, at least one pair of rows of article receiving bores of different cross-sectional area in said housing upper section for accommodating respective articles, said article receiving bores extending from said upper section towards said base member;

at least one pair of first channels in said upper section, said at least one pair of first channels associated with and extending generally parallel to said at least one pair of rows of receiving bores;

gauge means including a plurality of gauging elements respectively associated with the bores of said at least one pair of rows, said gauging elements being disposed along said at least one pair of first channels in proximity to the respective bores of the said at least one pair of rows, each of said gauging elements representing a cross-sectional area which at least approximates the cross-sectional area of the respective bore;

at least one second channel in said upper section, said at least one second channel extending transversely with respect to said at least one pair of first channels, and opening to said at least one pair of first channels, said second channel including gauging means adjacent at least one of said pair of rows of article receiving bores, for defining a cross-sectional area which at least approximates the cross-sectional area of the largest article receiving bore in said at least one row; and at least one receiving tube having a threaded bore aligned with at least one of the article receiving bores of said at least one pair of rows as an extension thereof.

2. The article holder of claim 1, wherein each of said article receiving bores has one of said receiving tubes associated therewith, further comprising adjustable means associated with at least one of said tubes for adjusting the depth of said at least one tube to accommodate the article to be received therein.

3. The article holder of claim 2, wherein the adjustable means comprise adjustment screws cooperatively engaging said threaded bores of said receiving tubes.

4. The article holder of claim 2, wherein said adjustment means can be activated from above through the bores of said receiving tubes.

5. The article holder of claim 2, wherein said adjustment means can be activated from below through said base member.

6. The article holder of claim 1, wherein said receiving tubes are removable.

7. The article holder of claim 6, wherein said receiving tubes comprise hemi-shells joined to one another by fastening means.

8. The article holder of claim 1, wherein said base member is a plate and has means to receive and align said receiving tubes.

9. The article holder of claim 1, wherein at least one of said gauging elements comprises a gauging plate having an opening along a margin of said gauging plate, said opening having a pair of mutually opposed edges defining the approximate cross-sectional area of the article receiving bore associated therewith.

10. An article holder, for tools which have cylindrical or polygonal shafts of different dimensions, said article holder comprising:

a housing having an upper section and a base member, at least one pair of rows of article receiving bores of different cross-sectional area in said housing upper section for accommodating respective articles, said article receiving bores extending from said upper section towards said base member;

at least one pair of first channels in said upper section, said at least one pair of first channels associated with and extending generally parallel to said at least one pair of rows of receiving bores;

gauge means including a plurality of gauging elements respectively associated with the article receiving bores of said at least one pair of rows, each of said gauging elements representing a cross-sectional area which at least approximates the cross-sectional area of the respective bore, each of said gauging elements being disposed in a pair of gauging element slots, said pairs of slots being disposed along at least one of said at least one pair of first channels, each slot of said pair of slots being disposed on an opposite side of said at least one of said at least one pair of first channels, said slots being located in proximity to the respective bores of the said at least one pair of rows;

at least one second channel in said upper section, said at least one second channel extending transversely with respect to said at least one pair of first channels, and opening to said at least one pair of first channels, said second channel including gauging means adjacent at least one of said pair of rows of article receiving bores, for defining a cross-sectional area which at least approximates the cross-sectional area of the largest article receiving bore in said at least one row; and at least one receiving tube having a threaded bore aligned with at least one of the article receiving bores of said at least one pair of rows as an extension thereof.

11. The article holder of claim 10, wherein at least one of said gauging elements comprises a gauging plate having an opening along a margin of said gauging plate, said opening having a pair of mutually opposed edges defining the approximate cross-sectional area of the article receiving bore associated therewith.

12. The article holder of claim 11, wherein said gauging plate is adapted to engagedly fit into said gauging element slots so that said pair of mutually opposed edges are disposed on opposite sides of said one of said first pair of channels.

13. The article holder of claim 11, wherein said gauging plate has at least two openings, each of said openings corresponding to one of said at least one pair of channels, so that at least two gauging elements are connected together.

14. The article holder of claim 13, wherein at least one of said gauging plates has coding means.

15. The article holder of claim 14, wherein reciprocal coding means are provided on the housing.

16. The article holder of claim 14, wherein reciprocal coding means are provided on said base plate.

17. The article holder of claim 1, wherein said upper section, said receiving tubes, and said gauging elements are cast or molded.

18. The article holder of claim 1, wherein said housing has internal voids, said voids being filled with a material to form a solid junction between said upper section and said base member.

19. The article holder of claim 18, wherein said upper section, said receiving tubes, and said gauging elements are cast or molded.

20. The article holder of claim 10, wherein said housing has internal voids, said voids being filled with a material to form a solid junction between said upper section and said base member.

* * * * *